US008548178B2

(12) United States Patent
Miles

(10) Patent No.: US 8,548,178 B2
(45) **Date of Patent: *Oct. 1, 2013**

(54) COMB SENSE MICROPHONE

(75) Inventor: Ronald Miles, Newark Valley, NY (US)

(73) Assignee: The Research Foundation of State University of New York, Binghamton, NY (US)

( * ) Notice: Subject to any disclaimer, the term of this patent is extended or adjusted under 35 U.S.C. 154(b) by 13 days.

This patent is subject to a terminal disclaimer.

(21) Appl. No.: 13/311,935

(22) Filed: Dec. 6, 2011

(65) Prior Publication Data

US 2012/0076329 A1 Mar. 29, 2012

Related U.S. Application Data

(63) Continuation of application No. 12/481,131, filed on Jun. 9, 2009, now Pat. No. 8,073,167, which is a continuation of application No. 11/198,370, filed on Aug. 5, 2005, now Pat. No. 7,545,945.

(51) Int. Cl.
*H04R 25/00* (2006.01)

(52) U.S. Cl.
USPC ..... 381/174; 381/191; 381/430

(58) Field of Classification Search
USPC ..... 381/171, 173–178, 181–182, 190–191, 381/427, 431
See application file for complete search history.

(56) References Cited

U.S. PATENT DOCUMENTS

| | | | | |
|---|---|---|---|---|
| 5,839,062 | A * | 11/1998 | Nguyen et al. | 455/323 |
| 5,952,974 | A * | 9/1999 | Ito et al. | 343/702 |
| 5,955,668 | A * | 9/1999 | Hsu et al. | 73/504.12 |
| 6,257,059 | B1 * | 7/2001 | Weinberg et al. | 73/504.16 |
| 6,578,420 | B1 * | 6/2003 | Hsu | 73/504.16 |
| 6,788,796 | B1 * | 9/2004 | Miles et al. | 381/357 |
| 6,928,720 | B2 * | 8/2005 | Kobayashi et al. | 29/594 |
| 6,963,653 | B1 * | 11/2005 | Miles | 381/424 |
| 7,036,372 | B2 * | 5/2006 | Chojnacki et al. | 73/504.12 |
| 2002/0189352 | A1 * | 12/2002 | Reeds et al. | 73/504.04 |
| 2004/0231420 | A1 * | 11/2004 | Xie et al. | 73/514.32 |
| 2005/0051910 | A1 * | 3/2005 | Goto et al. | 257/798 |
| 2005/0109107 | A1 * | 5/2005 | Park | 73/504.16 |

* cited by examiner

*Primary Examiner* — Suhan Ni
(74) *Attorney, Agent, or Firm* — Steven M. Hoffberg; Ostrolenk Faber LLP

(57) ABSTRACT

A miniature microphone, comprising a diaphragm, supported for displacement in response to acoustic waves, from which a plurality of projections extend; a plurality of projections extending from a surface; a body, supporting the surface to maintain the plurality of projections from the diaphragm and the plurality of projections from the surface in close proximity; and an electromagnetic sensor adapted to sense an electromagnetic interaction between the plurality of projections from the diaphragm and the plurality of projections from the surface and produce an electrical signal in response thereto. The interaction may be detected substantially without inducing a force which tends to substantially displace the diaphragm, since the electrostatic force is substantially parallel to the diaphragm surface.

19 Claims, 11 Drawing Sheets

COMB SENSE MICROPHONE

RELATED APPLICATIONS

This application is a continuation of U.S. patent application Ser. No. 12/481,131, filed Jun. 9, 2009, now U.S. Pat. No. 8,073,167, issued Dec. 6, 2011, titled COMB SENSE MICROPHONE, which is a continuation of U.S. patent application Ser. No. 11/198,370, filed Aug. 5, 2005, now U.S. Pat. No. 7,545,945, issued Jun. 9, 2009, titled COMB SENSE MICROPHONE, each of which expressly incorporated herein by reference. This application is also related to U.S. patent application Ser. No. 09/920,664, filed Aug. 1, 2001, titled DIFFERENTIAL MICROPHONE, now issued as U.S. Pat. No. 6,788,796, and application Ser. No. 10/302,528 filed Nov. 25, 2002, titled ROBUST DIAPHRAGM FOR AN ACOUSTICAL DEVICE and U.S. patent application Ser. No. 10/691,059, filed Oct. 22, 2003, titled HIGH-ORDER DIRECTIONAL MICROPHONE DIAPHRAGM, all of which are included herein in their entirety by reference.

STATEMENT OF GOVERNMENT INTEREST

This invention was made with Government support under R01DC005762 awarded by the National Institute of Health. The Government has certain right in the invention.

FIELD OF THE INVENTION

The invention pertains to capacitive microphones and, more particularly to capacitive microphones having rigid, silicon diaphragms with a plurality of fingers interdigitated and interacting with corresponding fingers of an adjacent, fixed frame.

BACKGROUND OF THE INVENTION

A common approach for transducing the motion of a microphone diaphragm into an electronic signal is to construct a parallel-plate capacitor where a fixed electrode (usually called a back plate) is placed in close proximity to a flexible (i.e., movable) microphone diaphragm. As the flexible diaphragm moves relative to the back plate in response to varying sound pressure, the capacitance of the microphone varies. This variation in capacitance may be translated to an electrical signal using a number of well known techniques. One such method is shown in FIG. 1 which is a schematic diagram of a typical capacitor (condenser) microphone 100 of the prior art. A fixed back plate 102 is spaced apart a distance d 106 from a flexible diaphragm 104. A DC bias voltage Vb is applied across back plate 102 and diaphragm 104.

An amplifier 110 has an input electrically connected to diaphragm 104 so as to produce an output voltage Vo in response to movement of diaphragm 104 relative to back plate 102. Because the output signal Vo is proportional to bias voltage Vb, it is desirable to make Vb as high as possible so as to maximize output signal voltage Vo of microphone 100.

Unfortunately, the bias voltage Vb exerts an electrostatic force on diaphragm 104 in the direction of the back plate. This limits the practical upper limit of the bias voltage Vb. This electrostatic force, f, is given by the equation:

$$f = \frac{d}{dx}\left(\frac{1}{2}CV_b^2\right) \tag{1}$$

where C is the capacitance of the microphone which may also be expressed:

$$C = \frac{\varepsilon A}{d + x} \tag{2}$$

where:

- $\epsilon$ is the permittivity of air ($\epsilon$=8.86×10$^{-12}$ farads/meter);
- A is the area of the diaphragm 104 of the microphone;
- d is the nominal distance 106 between the back plate 102 and the diaphragm 104; and
- x is the displacement of the diaphragm, a positive value indicating displacement away from the back plate 102.

Combining Equations (1) and (2) yields:

$$f = \frac{-V_b^2 \varepsilon A}{2(d + x)^2} \tag{3}$$

It will be noted that regardless of the polarity of Vb, this electrostatic force f acts to pull diaphragm 104 towards back plate 102. If Vb is increased beyond a certain magnitude, diaphragm 104 collapses against back plate 102. In order to avoid this collapse, the diaphragm must be designed to have sufficient stiffness. Unfortunately, this requirement for diaphragm stiffness conflicts with the need for high diaphragm compliance necessary to ensure responsiveness to sound pressure.

Because in microphones of this construction, electrostatic force f does not vary linearly with x, distortion of the output signal relative to the sensed acoustic pressure typically results.

Yet another problem occurs in these types of microphones. The presence of back plate 102 typically causes excessive viscous damping of the diaphragm 104. This damping is caused by the squeezing of the air in the narrow gap 106 separating the back plate 102 and the diaphragm 104.

The comb sense microphone of the present invention overcomes all of these shortcomings of microphones of the prior art.

SUMMARY OF THE INVENTION

In accordance with the present invention there is provided an ultra-miniature microphone incorporating a rigid silicon resiliently supported substrate which forms a diaphragm. A series of fingers disposed around the perimeter of the diaphragm interacts with mating fingers disposed adjacent the diaphragm fingers with a small gap in between.

In other words, the fingers are interdigitated. The movement of the diaphragm fingers relative to the fixed fingers varies the capacitance, thereby allowing creation of an electrical signal responsive to a varying sound pressure at the diaphragm. Because the electrostatic force on the fingers does not have a significant dependence on the out-of-plane displacement of the diaphragm, the classic problem of attraction of the diaphragm to the back plate discussed hereinabove is effectively overcome. The diaphragm can be designed to be very compliant without creating instabilities due to electrostatic forces. The multiple fingers allow creation of a microphone having a high output voltage relative to microphones of the prior art. This, in turn, allows creation of very low noise microphones.

The diaphragm is readily formed using well-known silicon microfabrication techniques to yield low manufacturing costs.

It should be noted that many capacitive sensors utilize interdigitated comb fingers. The primary uses of this sensing approach are in silicon accelerometers and gyroscopes well known to those of skill in those arts. See, e.g., U.S. Pat. Nos. 5,233,213, 5,505,084, 5,635,639, 5,796,001, 6,032,352, 6,473,187, 6,904,804, 7,013,730, 7,024,933, 7,047,808, 7,074,637, 7,075,160, 7,077,007, each of which is expressly incorporated herein by reference. Such sensors generally consist of a resiliently supported proof mass that moves relative to the surrounding substrate due to the motion of the substrate. An essential feature of these constructions is that the proof mass is supported only on a small fraction of its perimeter, allowing a significant portion of the perimeter to be available for capacitive detection of the relative motion of the proof mass and the surrounding substrate through the use of comb fingers. This requirement has precluded the use of comb fingers for capacitive sensing in microphones because the typical approach to the formation of a microphone diaphragm is to construct a very thin plate that is effectively clamped along its entire perimeter. Because silicon accelerometers and gyroscopes utilize compliant hinges rather than entirely clamped perimeters, they readily permit the use of comb fingers for sensing.

BRIEF DESCRIPTION OF THE DRAWINGS

A complete understanding of the present invention may be obtained by reference to the accompanying drawings when considered in conjunction with the subsequent detailed description, in which.

DETAILED DESCRIPTION OF THE PREFERRED EMBODIMENT

Figure 1:
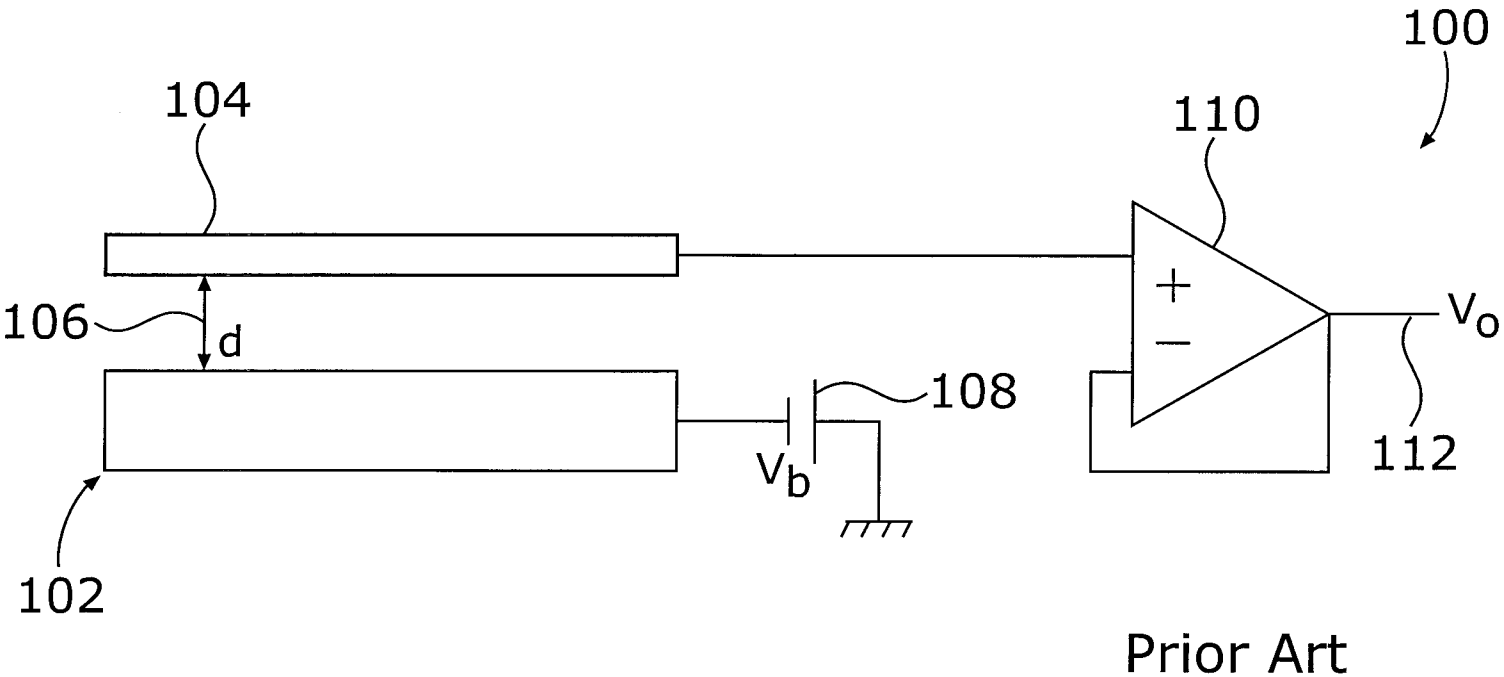
Prior Art Figure 1
FIG. 1 is an electrical schematic diagram of a typical capacitive microphone of the prior art.

A highly efficient capacitance microphone that overcomes the deficiencies of classic capacitance microphones of the prior art described hereinabove may be formed by making a diaphragm having a series of fingers disposed around its perimeter. These fingers are then interdigitated with corresponding fingers on a fixed structure analogous to a back plate in microphone 100 (FIG. 1). That is, the sets of interdigitated fingers are generally coplanar, and electrostatic forces act along the plane of the diaphragm, rather than normal to it, as is the case in known designs.

Figure 2A:
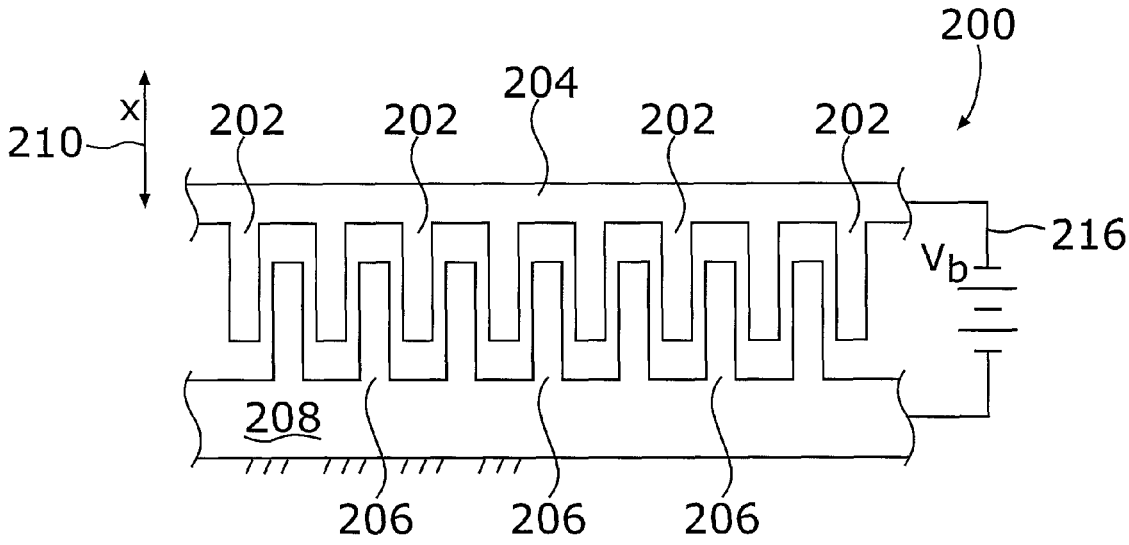
FIG. 2A is a schematic, plan view of an interdigitated finger structure suitable for use in the microphone of the invention.

Referring now to FIG. 2A, there is shown a schematic cross-sectional view of an interdigitated finger structure, generally at reference number 200. A series of fingers 202 projects from the surface of a substrate 204. The surface of substrate 204 is free to move out of the plane of the figure and forms the diaphragm of a microphone. Additional fingers 206 project from the surface of a fixed structure 208 representative of a microphone back plate. Fingers 202 projecting from diaphragm 204 are free to move with the diaphragm out of the plane of the figure as well as in the direction x indicated by arrow 210 relative to the fixed structure 208.

Figure 2B:
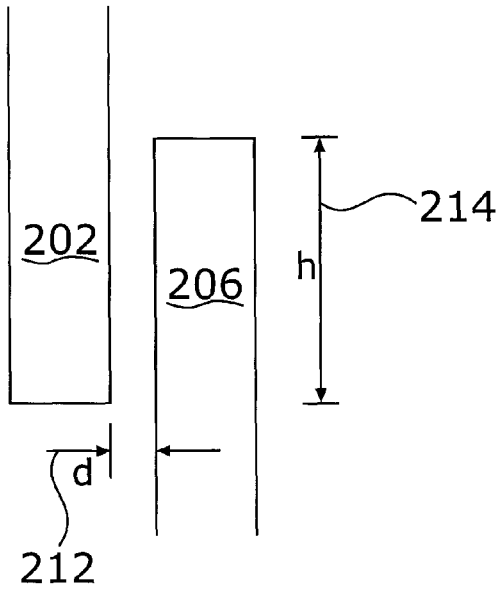
FIG. 2B is a detailed schematic end view of one finger pair of the interdigitated finger structure of FIG. 2A.

Referring now also to FIG. 2B, there is shown an end view of a portion of the fingers of FIG. 2A showing one each of fingers 202, 206. Fingers 202 and 206 are separated by a gap d 212. Fingers 202 and 206 may overlap one another a distance h 214.

Each finger 202, 206 has a length l (not shown) in a direction perpendicular to the cross-sectional view of FIG. 2B. The length l of each finger depends on several factors such as the available area of the diaphragm 204, and on other practical fabrication considerations.

The total capacitance C of a microphone structure using the interdigitation technique of FIGS. 2A and 2B may be roughly estimated by:

$$C = \frac{\varepsilon(h-x)}{d} l2N \tag{4}$$

where x is the displacement of the diaphragm, and N is the number of fingers. In equation (4) it is assumed that the nominal overlap distance is h 214 as shown in FIG. 2B. It should be noted that it is not essential that the fingers overlap with h being a positive value. In this case, however, the capacitance will not be accurately estimated by equation (4) and must be estimated by other means.

If a bias voltage Vb 216 (FIG. 2A) is then applied between diaphragm 204 and back plate 208, Equations (1) and (4) show the resulting electrostatic force f (for small x, neglecting fringing effects) to be:

$$f = \frac{d}{dx}\left(\frac{1}{2}\frac{\varepsilon(h-x)}{d} l2NV_b^2\right) = -\frac{\varepsilon}{d} lNV_b^2 \tag{5}$$

Equation (5) clearly shows that the nonlinear dependence of f on x (Equation 3) for the parallel plate microphone 100 (FIG. 1) of the prior art no longer exists. Consequently, bias voltage Vb does not reduce the stability of the diaphragm's motion in the x direction; a significantly higher bias voltage Vb may be used without a need to increase diaphragm stiffness, resulting in increased microphone sensitivity without the diaphragm collapse problems of prior art microphones.

In all capacitive sensing applications, the applied static voltage results in an attractive force that acts to bring the moving sensing electrode toward the fixed electrode. In the case of the present comb-sense microphone, this attractive force acts to bring the microphone diaphragm toward its neutral position (i.e., x=0), in line with the fixed fingers. As a result, the bias voltage tends to stabilize the diaphragm rather than lead to instability. As long as the fingers are designed so that they themselves will resist collapsing toward each other, the diaphragm's compliance does not need to be adjusted to avoid collapse against the fixed electrodes. For small displacements, the electrostatic force along the axis of movement tends to return the diaphragm to a zero displacement position, with a force proportionate to the displacement. If for example, the interdigital fingers may be provided on opposing sides of the diaphragm structure, so that the forces tending to displace it with respect to the finger gap balance each other. This means that the diaphragm may be designed to be highly compliant and thus very responsive to sound.

Figure 3:
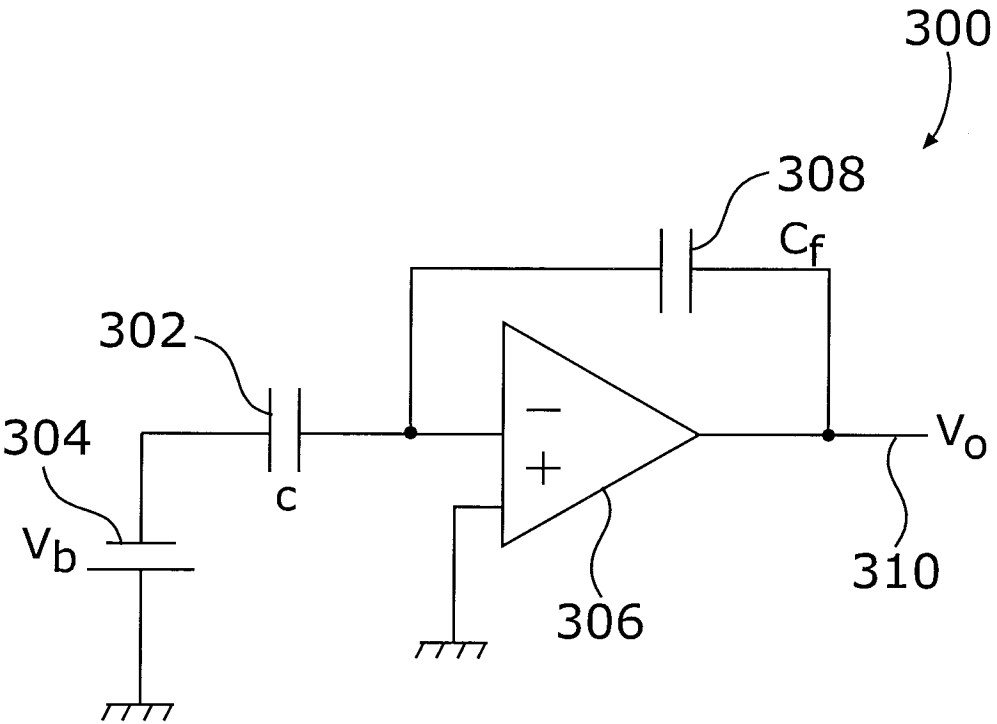
FIG. 3 is an electrical schematic diagram of a capacitive microphone in accordance with the invention.
Figure 4:
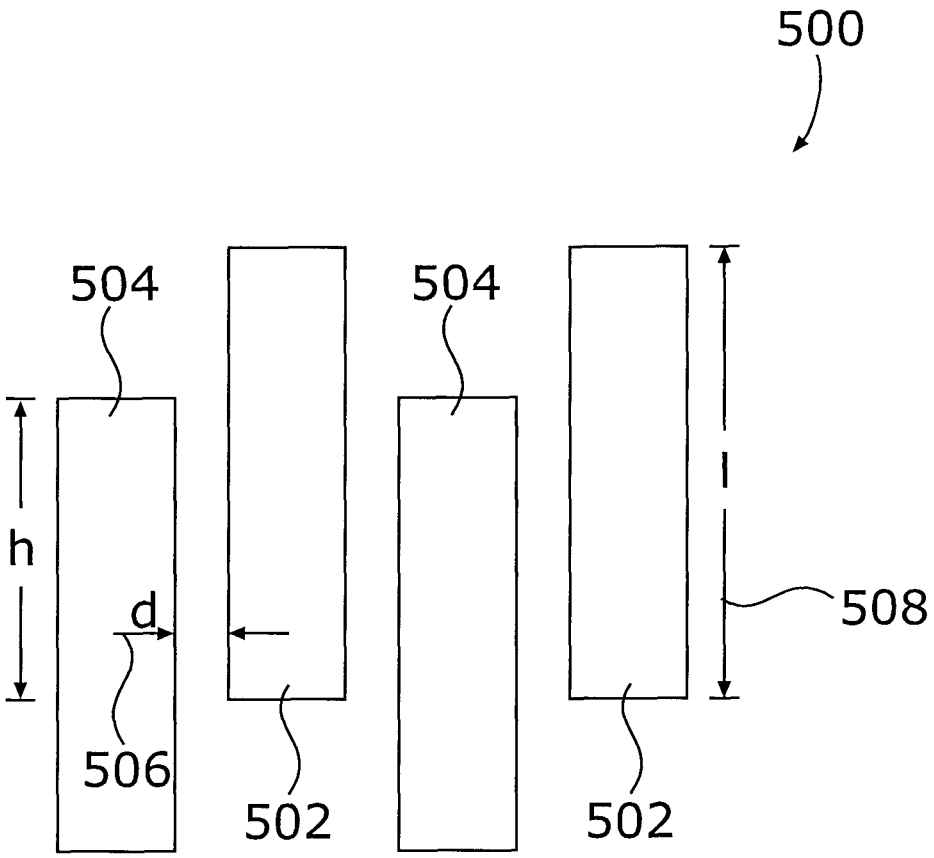
FIG. 4 is an end view of two pairs of interdigitated fingers.

One possible way to obtain an electrical signal from a capacitive microphone is shown in the circuit of FIG. 3, generally at reference number 300. A capacitive microphone 302 has a bias voltage Vb 304 applied to one electrical connection thereof. The second electrical connection of microphone 304 is connected to the negative (−) input of an operational amplifier 306, the positive (+) input of operational amplifier 306 being connected to ground. A feedback capacitor Cf 308 is connected between the output of amplifier 306 and the negative (−) input thereof. Because C may be expressed by Equation (4), the output voltage Vo 310 of amplifier 306 is:

$$V_o = -V_b\frac{C}{C_f} = \frac{-V_b}{C_f}\left(\frac{\varepsilon(h-x)}{d}l2N\right) \tag{6}$$

where Cf 308 is the feedback capacitance. The output voltage Vo 310 given by Equation (6) may be separated into DC and AC components:

$$V_o = \frac{-V_b}{C_f}\varepsilon hl\frac{2N}{d} + x\frac{V_b}{C_f}\varepsilon l\frac{2N}{d} \tag{7}$$

which varies linearly with the displacement x of the microphone diaphragm 204.

If microphone 302 is fabricated in silicon, then reasonable parameters for microphone 302 may be: l=approximately 100 μm; d=1 μm; h=5 μm; and N=100.

The diaphragm 204 (FIG. 2A) is assumed to deflect approximately 20 nm for every 1 Pascal sound pressure, although in other designs, the deflection can be between about 1 and 1,000 nm/Pascal, more typically between about 1 and 100 nm/Pascal, and preferably between about 5 and 50 nm/Pascal. Assuming a feedback capacitor of approximately 1.5 pf, the output voltage Vo will be:

$$V_o \cong V_b \times 0.0024 \text{ volts/Pascal} \tag{8}$$

Using a bias voltage Vb 304 of 10 volts provides an output sensitivity of approximately 2.4 mV/Pascal. It will be recognized that if the inter-finger gap d 212 (FIG. 2B) is reduced to approximately 0.1 μm, a value that is obtainable using currently known silicon microfabrication techniques, then the output voltage Vo 310 may be increased by a factor of 10. In other words, the voltage Vb 304 may be reduced to 1 volt and, with the 0.1 μm gaps, the same 2.4 mV/Pascal output sensitivity may be obtained.

It should be noted that while a significant advantage of this invention is that the bias voltage does not adversely affect the stability of the diaphragm in the x direction, one must still be careful to design the fingers so that they have sufficient stiffness to avoid the situation where the neutral position of the fingers is made to be unstable by the use of too large a value of Vb. In this case, the fingers may deflect such that they touch each other and reduce the performance of the capacitive sensing system. However, it is important to emphasize that the design requirements for the stiffness of the fingers are uncoupled from the requirements that determine the compliance of the diaphragm; it is desirable to use stiff fingers along with a diaphragm that is very compliant in the x direction so that the diaphragm is highly responsive to sound.

In addition to considering the effect of the electrostatic forces on the stability of the fingers, it is not possible to use an arbitrarily large bias voltage because the finite break-down voltage of the air in the gap between the fingers may allow current to flow across the gap which would have a dramatic affect on the electronic signal.

Figure 5:
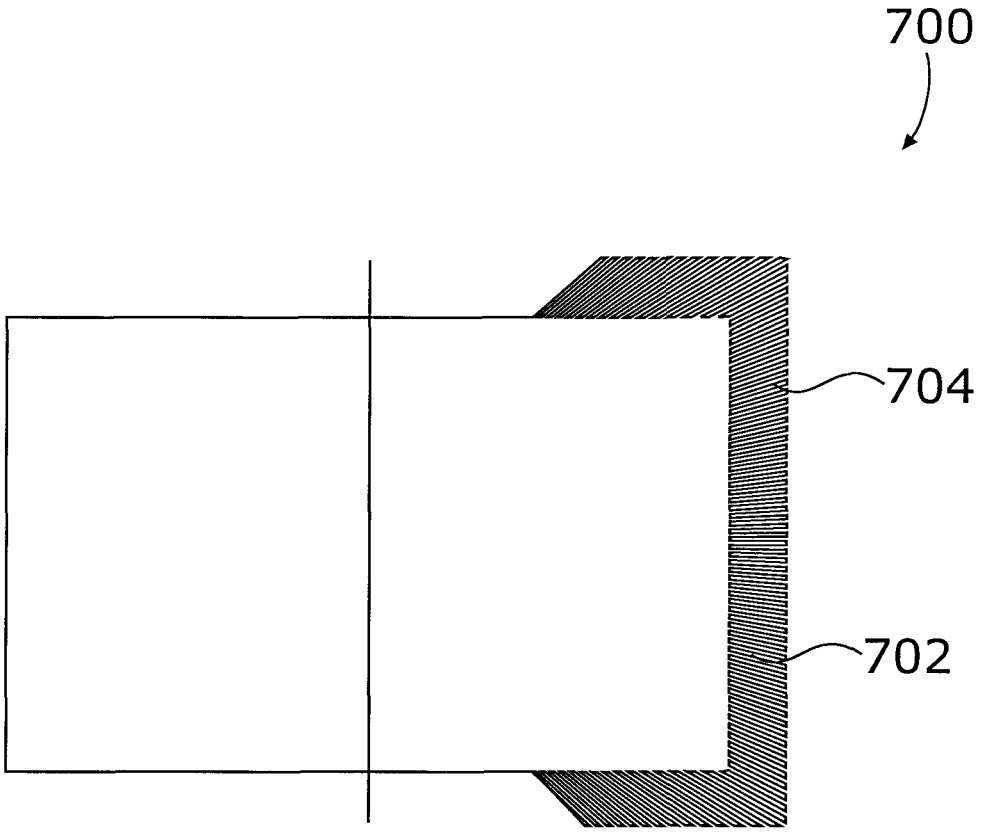
FIG. 5 is a schematic plan view of a typical diaphragm in accordance with the present invention having a number of fingers disposed thereupon.
Figure 6:
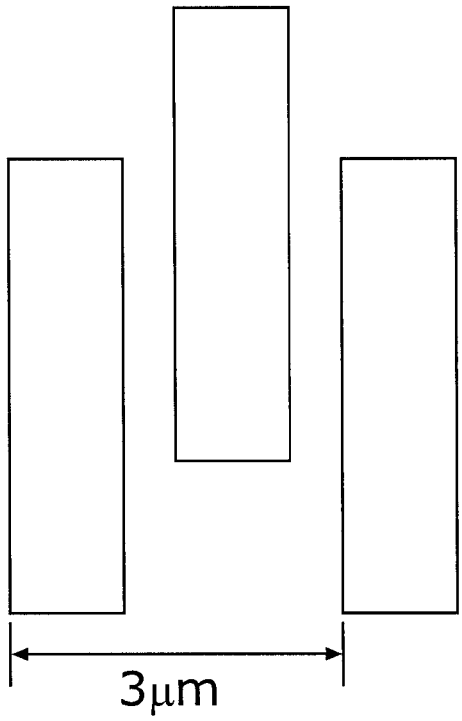
FIG. 6 is an end view of three interdigitated fingers.
Figure 7:
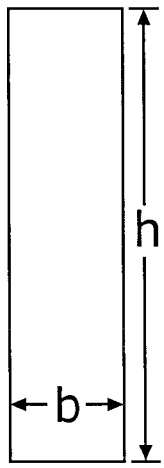
FIG. 7 is an end view of a single finger.

Referring now to FIG. 5, there is shown a schematic representation of a typical diaphragm 700 in accordance with the present invention. Diaphragm 700 has a number of fingers N disposed in a finger region at one end of the diaphragm. Assuming a period of approximately 3 μm (FIG. 6), the number N of fingers which may be placed at each end of the diaphragm may be estimated as:

$$N = \frac{Ylength + \frac{2Xlength}{4}}{3\ \mu\text{m}} \tag{9}$$

If Xlength is approximately 2,000 μm and Ylength is approximately 1,000 μm, then $$N = \frac{2000\times10^{-6}}{3\times10^{-6}} = 666.$$

A practical microphone diaphragm in accordance with the inventive concepts may be microfabricated in polysilicon. Advantageously, the substrate is prestressed, and accordingly deforms slightly, or is otherwise intentionally deflected, resulting in an offset of the respective fingers such that the operating range of the device assures that the interdigital capacitance transducer structure does not reach the neutral position, at which displacements in either direction increase capacitance resulting in reduced sensitivity and position ambiguity. Therefore, a net bias voltage will tend to return the transducer diaphragm toward that null position, but should not fully compensate for that offset.

Figure 8A:
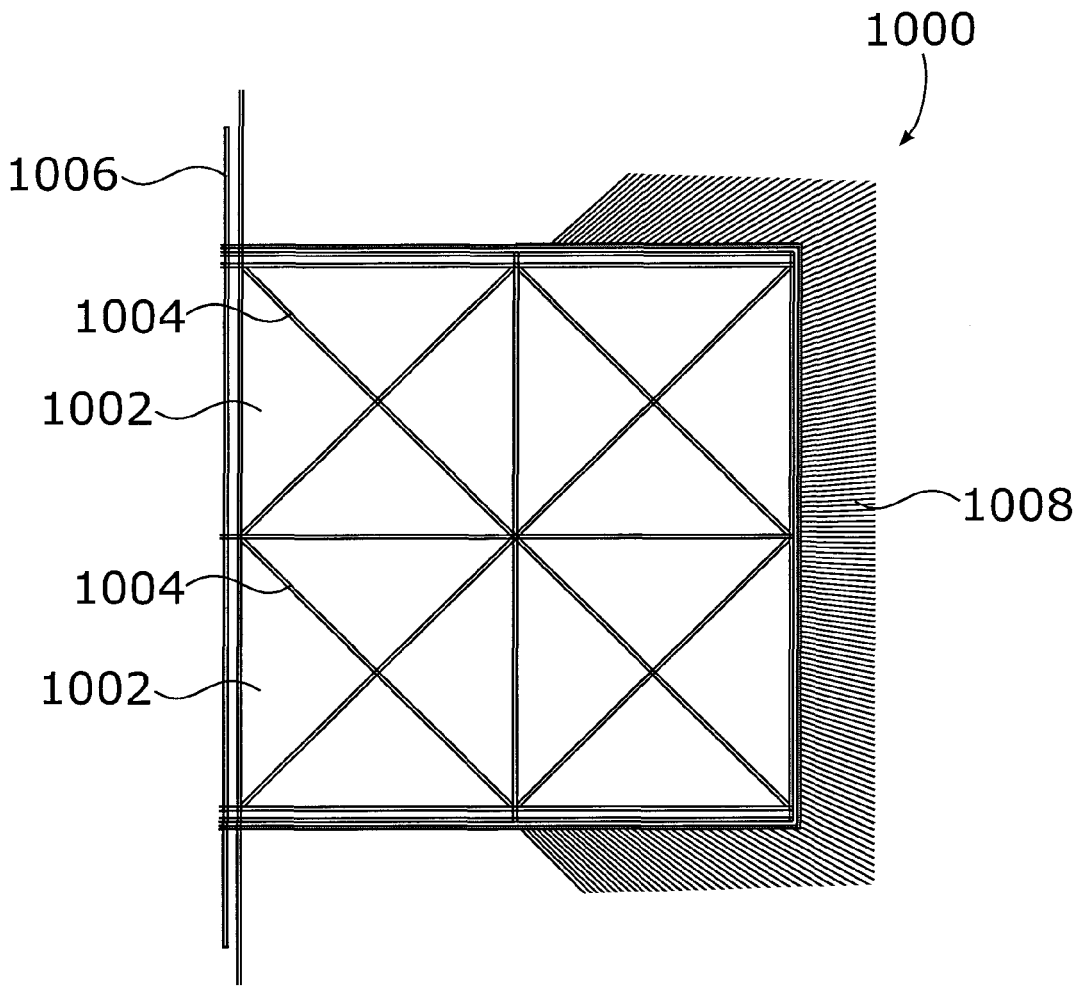
FIGS. 8A and 8B are plan schematic views of omnidirectional and differential diaphragms, respectively, in accordance with the invention.

Referring now to FIG. 8A there is shown a plan schematic view of a diaphragm in accordance with the present invention suitable for use in an omnidirectional microphone, generally at reference number 1000. A rigid silicon diaphragm 1002 has stiffening ribs 1004 disposed on a least one face thereof. Diaphragm 1002 is free to rotate about a pivot or hinge 1006. Such a diaphragm is described in detail in U.S. patent application Ser. No. 10/302,528, which is expressly incorporated herein by reference. In alternate embodiments, diaphragm 1002 may be resiliently supported by mechanisms other than a hinge or pivot 1006. For example, diaphragm 1002 could be supported by one or more springs or other resilient structures, not shown, at or near corners of diaphragm 1002. Such springs could support diaphragm 1002 from below in compression or could support diaphragm 1002 from above in tension. Another example of this is a cantilever support, which would allow the diaphragm 1002 to be supported on one side, and flex about the support axis. In yet other embodiments, diaphragm 1002 could be supported on a resilient pad (e.g., a foam pad). The inventive diaphragm with its interdigitated finger structure is not intended to be limited to a particular support structure or method but is seen to include any means for resiliently supporting diaphragm 1002.

A series of sensing fingers 1008 is disposed radially around a portion on the perimeter of diaphragm 1002. Fingers 508 have been described hereinabove. Fingers 1008 are adapted for interdigitation with corresponding fingers, not shown, on a surrounding, fixed frame, not shown.

It will be recognized that radial disposition of the fingers eliminates potential interference between the diaphragm fingers 1008 and the interdigitated fingers on a surrounding substrate, not shown, caused by strain in the diaphragm 1002. If a diaphragm 1002 can be fabricated and supported in a manner wherein strain is effectively eliminated, finger arrangements other than radial disposition 25 may also be used. Consequently, the inventive concept is not limited to radial finger disposition but is seen to encompass any interdigitated finger arrangement.

Figure 8B:
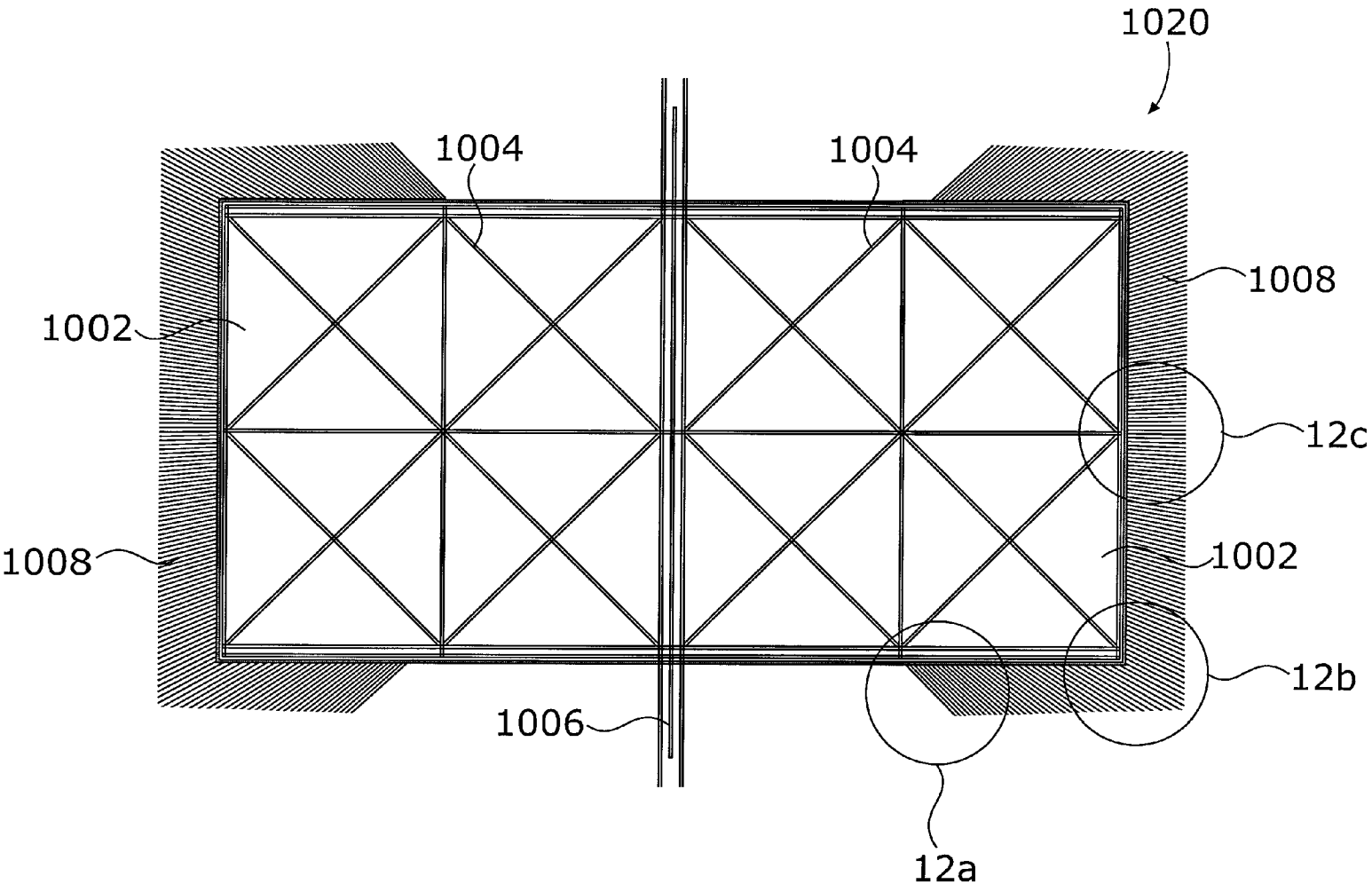

FIG. 8B shows a plan schematic diagram of a diaphragm in accordance with the present invention suitable for use in a differential microphone, generally at reference number 1020. A similar differential microphone is the subject of U.S. Pat. No. 6,788,796, expressly incorporated herein by reference. The structure of diaphragm 1020 is similar to omnidirectional diaphragm 1000 (FIG. 8A) except that the pivot 1006 is disposed in the middle of diaphragm 1020 and fingers 1008 are disposed at each end thereof.

Figure 9A:
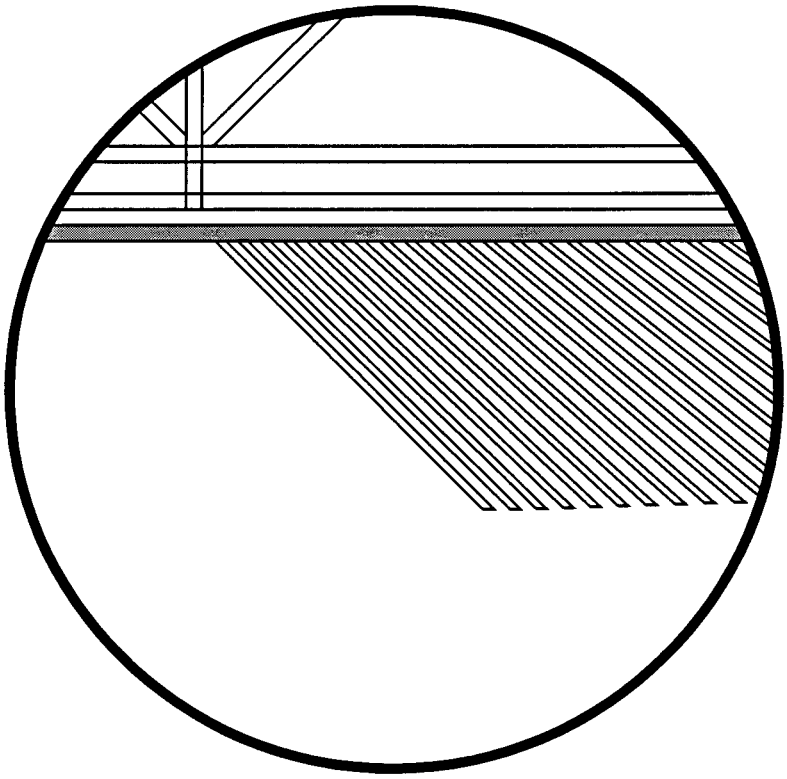
FIGS. 9A-9C are, respectively, schematic plan views of the diaphragm of FIG. 8B and enlarged views of portions thereof.
Figure 9B:
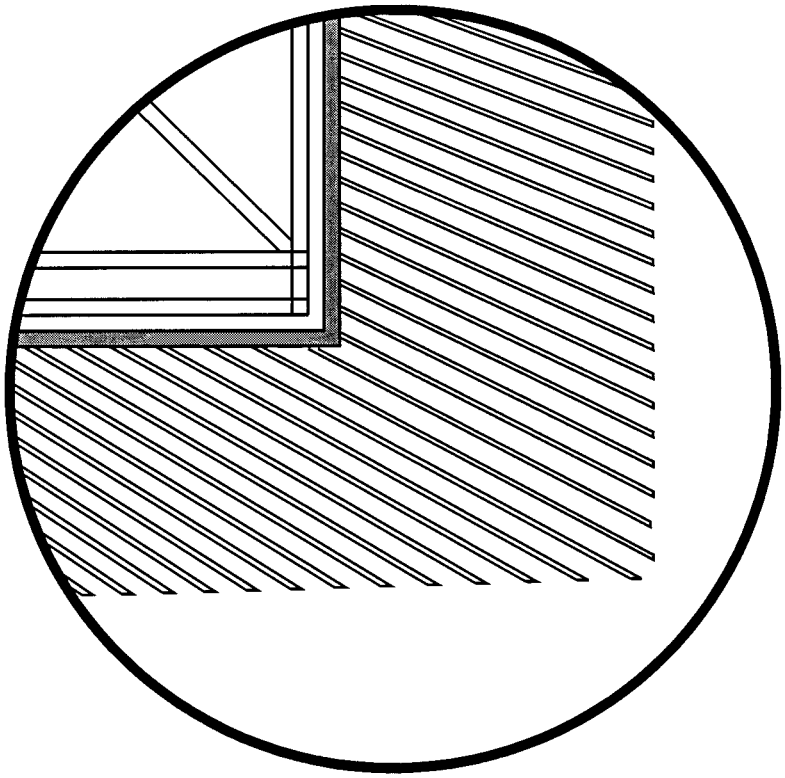
Figure 9C:
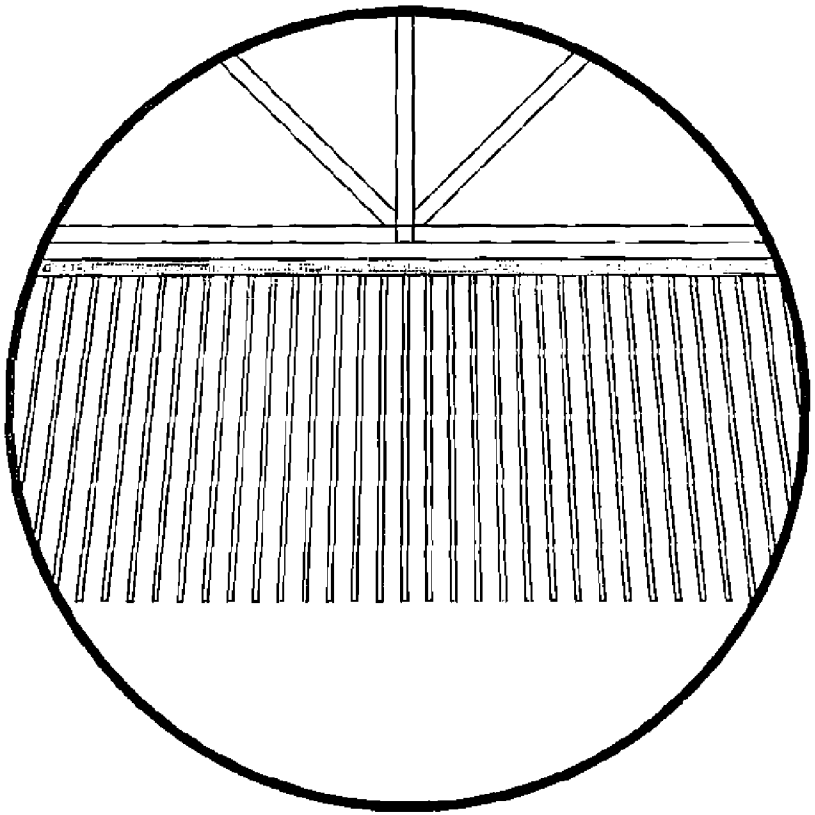

Referring now to FIGS. 9A-9C, there are shown enlarged views of three regions of diaphragm 1002 identified in FIG. 8B.

It will be recognized that all fingers 1008 are disposed radially from respective geometric centers of diaphragms 1000 (FIG. 8) and 1020 such that as each diaphragm 1000, 1020 moves in response to in-plane stresses and strains that occur during fabrication, not shown, fingers 1008 each move in substantially a single plane relative to their corresponding, fixed fingers. The radial arrangement of the fingers prevents them from getting stuck together when the diaphragm shrinks or expands during fabrication. The fingers radiate from a point on the diaphragm that doesn't move relative to the surrounding substrate. While substantially rectangular diaphragms (FIGS. 8A, 8B) have been chosen for purposes of disclosure, the inventive concept of radially disposed fingers may be applied to diaphragms of other shapes. Consequently, the invention is not considered limited to such rectangular diaphragms chosen for purposes of disclosure but rather is seen to encompass diaphragms of any other shape. Also, in the embodiments chosen for purposes of disclosure, fingers are said to radiate from a geometric center of the diaphragm, it will be recognized that fingers may radiate radially relative to any point on the diaphragm that remains fixed relative to the surrounding substrate with which such fingers are interdigitated. Consequently, the inventive concept is not considered limited to embodiments wherein fingers radiate only from a geometric center of the diaphragm. It should also be noted that the orientation of the fingers may be determined by other considerations if the shrinkage or expansion of the diaphragm relative to the substrate is not significant relative to the distance between the fingers.

In a typical realization of a microphone in accordance with the present invention, fingers 1008 may be approximately 100 μm in length and may be spaced approximately 1.0 μm (i.e., that have approximately a 3 μm period).

While a capacitance microphone configuration has been described for purposes of disclosure, it is possible to create microphones or other similar devices using sensing methods other than capacitance. For example, a light source may be modulated by movement of the diaphragm fingers and used to generate an output signal. Optical interferometry techniques may also be used to generate an output signal representative of the movement of a diaphragm by sound pressure, vibration, or any other actuating force acting thereupon. Consequently, the inventive concept is not seen limited to capacitive sensing microphones but rather is seen to include any microphone or similar device having fingers disposed around a perimeter of diaphragm regardless of the technology used to sense diaphragm movement.

In a typical use of the microphone, an electronic circuit senses the capacitance of the interdigital capacitor structure, and produces an electrical signal in response thereto. The device may also include an electromechanical transducer, e.g., a speaker, which may produce sounds in response to a processed version of the electrical signal, such as in a hearing aid, or in response to remotely transmitted representations of sounds, e.g., a headset, telephone or radio-telephone, such as a cellular telephone.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A microphone, comprising:

a) a body, supporting a plurality of finger electrodes;

b) a diaphragm mounted for displacement in response to acoustic waves on the body by at least one mounting, having a plurality of corresponding finger electrodes configured to generate a electrical capacitance signal with respect to the finger electrodes;

c) an electrical connection, configured to apply an electrical bias between the plurality of finger electrodes and the plurality of corresponding finger electrodes, and to read an electrical signal corresponding to a change in capacitance between the finger electrodes and the corresponding finger electrodes representing a displacement of the diaphragm with respect to the body due to the acoustic waves, wherein the corresponding finger electrodes of the diaphragm electrically communicate through the at least one mounting, while maintaining electrical isolation from the finger electrodes of the body.

2. The microphone according to claim 1, further comprising an amplifier configured to produce an electrical output corresponding to a displacement of said diaphragm.

3. The microphone according to claim 1, wherein the plurality of corresponding finger electrodes of the diaphragm project radially from the diaphragm with respect to a predetermined point.

4. The microphone according to claim 3, wherein the predetermined point is located proximate to a geometric center of the diaphragm.

5. The microphone according to claim 1, wherein the at least one mounting comprises a resilient support, and wherein the body is configured such that the electrical bias does not have a substantial tendency to collapse the diaphragm toward a back plate counterelectrode.

6. The microphone according to claim 5, wherein said resilient support comprises a hinge.

7. The microphone according to claim 5, wherein said resilient support comprises a spring.

8. The microphone according to claim 5, wherein said resilient support comprises a resilient pad.

9. The microphone according to claim 5, wherein said resilient support comprises a pair of hinges, each being disposed at a different position about a perimeter of said diaphragm.

10. The microphone according to claim 6, wherein said diaphragm is substantially rectangular and supported for angular rocking in response to acoustic waves, the plurality of corresponding finger electrodes being selectively grouped along at least a side of the substantially rectangular diaphragm with maximum displacement with respect to the acoustic waves.

11. The microphone according to claim 1, wherein the electrical bias produces a force substantially parallel to a plane of the diaphragm.

12. A method of sensing acoustic waves, comprising:

providing a microphone body, supporting a plurality of finger electrodes, and a diaphragm mounted for displacement in response to acoustic waves on the body by at least one mounting, having a plurality of corresponding finger electrodes configured to generate a electrical capacitance signal with respect to the finger electrodes; and electrically communicating with the plurality of corresponding finger electrodes through the mounting, while maintaining substantial electrical isolation between the plurality of finger electrodes and the corresponding finger electrodes, for:

applying an electrical bias between the plurality of finger electrodes and the corresponding finger electrodes; and reading an electrical signal corresponding to a change in capacitance between the plurality of finger electrodes and the corresponding finger electrodes representing a displacement of the diaphragm with respect to the body due to the acoustic waves.

13. The method according to claim 12, further comprising amplifying the electrical signal with an amplifier to produce an electrical output corresponding to a displacement of said diaphragm.

14. The method according to claim 12, wherein the plurality of corresponding finger electrodes of the diaphragm project radially from the diaphragm with respect to a predetermined point.

15. The method according to claim 14, wherein the predetermined point is located proximate to a geometric center of the diaphragm.

16. The method according to claim 12, wherein the at least one mounting comprises a resilient support, and wherein the body is configured such that the electrical bias does not have a substantial tendency to collapse the diaphragm toward a back plate counterelectrode.

17. The method according to claim 16, wherein said resilient support comprises a hinge, wherein the electrical bias produces a force substantially parallel to a plane of the diaphragm.

18. The method according to claim 16, wherein said resilient support comprises a pair of hinges, each being disposed at a different position about a perimeter of said diaphragm, and said diaphragm is substantially rectangular and supported for angular rocking in response to acoustic waves, the plurality of corresponding finger electrodes being selectively grouped along at least a side of the substantially rectangular diaphragm with maximum displacement with respect to the acoustic waves.

19. The microphone according to claim 1, wherein the plurality of corresponding finger electrodes tend to produce a centering force on the diaphragm with respect to the plurality of finger electrodes, the displacement of the diaphragm is a rocking displacement of the diaphragm with respect to the body due to acoustic wave, the mounting comprises at least one hinge through which the corresponding finger electrodes of the diaphragm electrically communicate from the body to the diaphragm.

* * * * *